US008925214B1

(12) United States Patent
Gochis

(10) Patent No.: US 8,925,214 B1
(45) Date of Patent: Jan. 6, 2015

(54) ALIGNMENT SYSTEM AND METHOD FOR CREATING HOLES FOR PILES OR OTHER SUPPORT MEMBERS

(76) Inventor: Bernard J. Gochis, Westminster, CO (US)

( * ) Notice: Subject to any disclaimer, the term of this patent is extended or adjusted under 35 U.S.C. 154(b) by 159 days.

(21) Appl. No.: 13/532,611

(22) Filed: Jun. 25, 2012

Related U.S. Application Data

(60) Provisional application No. 61/500,439, filed on Jun. 23, 2011.

(51) Int. Cl.

| | |
|---|---|
| ***G01D 21/00*** | (2006.01) |
| *B23B 49/00* | (2006.01) |
| *B23Q 17/22* | (2006.01) |
| *B25H 7/00* | (2006.01) |

(52) U.S. Cl.
USPC ..... 33/645; 33/520; 33/638; 33/670; 33/671

(58) Field of Classification Search
CPC ..... G01B 5/25; G01B 5/24
USPC ..... 33/645, 1, 520, 638, 670, 671; 175/431
See application file for complete search history.

(56) References Cited

U.S. PATENT DOCUMENTS 3,162,066 A * 12/1964 Morey et al. ..... 408/76

* cited by examiner

*Primary Examiner* — Peter Macchiarolo
*Assistant Examiner* — Rhyan C Lange
(74) *Attorney, Agent, or Firm* — Sheridan Law, LLC

(57) ABSTRACT

An alignment system and method for aligning a hole-making device for forming a hole in the ground. In one example, the alignment system includes an alignment template selectively securable to the ground; and a centering plate positionable within the alignment template, the centering plate having a hole adapted to be positioned on a survey pin or nail or other mark. The alignment template is aligned relative to desired marked hole location, and the hole making device is aligned relative to the template, which thereby aligns the hole making device relative to the marked hole location.

22 Claims, 5 Drawing Sheets

ALIGNMENT SYSTEM AND METHOD FOR CREATING HOLES FOR PILES OR OTHER SUPPORT MEMBERS

CROSS-REFERENCE TO RELATED APPLICATIONS

This application claims the benefit under 35 U.S.C. §119 (e) of U.S. Provisional Patent Application No. 61/500,439 filed Jun. 23, 2011 entitled "ALIGNMENT SYSTEM AND METHOD FOR CREATING HOLES FOR PILES OR OTHER SUPPORT MEMBERS" the disclosure of which is hereby incorporated by reference in its entirety.

FIELD OF THE INVENTION

This invention relates, in general, to devices that assist in precision alignment of machinery for making holes in the ground.

BACKGROUND OF THE INVENTION

Various conventional techniques exist for creating holes in the ground to receive a pile, piers, anchors or support members. For instance, conventional techniques include use of a large drill with a rotary drill bit, which bores out the soils or other materials below ground. Moreover, expedient and accurate alignment over survey hubs is often needed in situations when creating holes.

However, as recognized by the present inventor, situations exist where it is undesirable or impractical to bore out materials from below the ground surface, for instance, when the below ground soils are weak, which therefore tends to collapse the hole as it is drilled, or when spoils may not be desired such as in environmentally sensitive areas.

As recognized by the present inventor, what is needed is a device for precise alignment of holes to be created, such as via compression hammering for pilot holes for later insertion of a pile within the pilot hole.

SUMMARY

In light of the above and according to one broad aspect of one embodiment of the present invention, disclosed herein is an alignment system for aligning a hole-making device for forming a hole in the ground. In one example, the alignment system includes an alignment template selectively securable to the ground; and a centering plate positionable within the alignment template, the centering plate having a hole adapted to be positioned on a survey hub (e.g., survey pin, nail or other mark).

In one example of an embodiment of the present invention, the alignment template may include at least one retaining ring. The alignment template may include at least one pin sleeve attached on the outer perimeter of the ring, the pin sleeve receiving a pin to secure the alignment template to the ground.

The alignment template may also include at least one support plate positioned along a lower edge of said retaining ring, or at least two support plates positioned along apart from each other along a lower edge of said retaining ring.

The alignment template may include at least one ring having an inner diameter that is greater than an outer diameter of the centering plate. In one example, the centering plate has at least one handle.

According to another broad aspect of another embodiment of the present invention, disclosed herein is an alignment system for aligning a hole-making device for forming a hole in the ground. In one example, the system includes a centering plate having a hole adapted to be positioned on a survey hub; and an alignment template selectively securable to the ground, the alignment template adapted to removably receive the centering plate in order to position the alignment template relative to the centering plate and the survey hub, and the alignment template adapted to removably receive an end of the hole making device in order to position the hole making device relative to the survey hub.

In one example, the centering plate substantially defines a circle and may include at least one handle. The hole of the centering plate may be positioned in the center of the centering plate.

In one example, alignment template includes at least one ring having an inner diameter that is greater than an outer diameter of the centering plate. The alignment template may also include at least one pin sleeve attached on the outer perimeter of the ring, the pin sleeve receiving a pin to secure the alignment template to the ground. The alignment template may also include at least one support plate positioned along a lower edge of said retaining ring.

According to another broad aspect of another embodiment of the present invention, disclosed herein is a method for positioning a hole-making device to make a hole in the ground, which can be used for instance to receive a structural member such as a pile member or other structure or material. In one example, the method includes surveying a desired location for the hole; marking the location of the hole; positioning an alignment template about the marked location; positioning a centering plate within the alignment template, the centering plate being positioned about the marked location; securing the alignment template into the ground; removing the centering plate from the alignment template; and positioning the hole making device within the alignment template. In this manner, the hole making device is precisely located relative to the marked location.

In one example, the method may also include vertically aligning hole making device using a plum line. In another example, the marking operation includes driving a survey nail into the ground or marking the desired hole location using any conventional marking element or technique.

In one example, the securing operation may include attaching one or more pin sleeves to the alignment template and driving one or more pins through the pin sleeves into the ground. The operation of positioning the hole making device within the alignment template may also include inserting a tip or end of the hole making device within a receiving portion of the alignment template. In this manner, the template is aligned relative to desired marked hole location, and the hole making device is aligned relative to the template, which thereby aligns the hole making device relative to the marked hole location.

The features, utilities and advantages of the various embodiments of the invention will be apparent from the following more particular description of embodiments of the invention as illustrated in the accompanying drawings.

DETAILED DESCRIPTION

Figure 1:
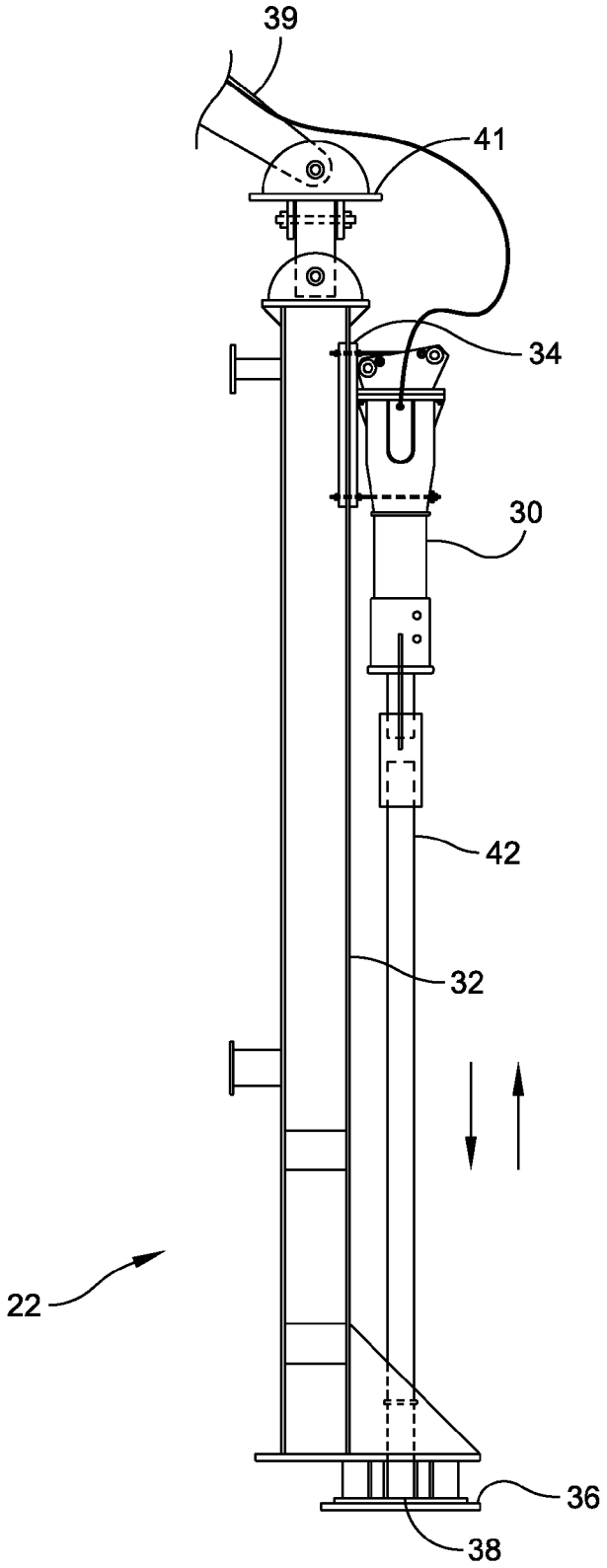
FIG. 1 illustrates an example of device for creating a hole in the ground, in accordance with one embodiment of the present invention.

Disclosed herein are various embodiments of an alignment system 20 and methods to create a hole in the ground or other surface in a precise location. Various embodiments of the invention are disclosed herein, and various uses of embodiments of the invention are possible. In one example, the alignment system 20 can be used with various hole making devices 22 (such as shown in FIG. 1) to create a precisely located pilot hole for later insertion of a pile member or other structural member or material into the pilot hole, which can then be used to support a foundation or other structure. Other examples of possible uses of the alignment system 20 include creating holes in the ground that can be used to receive pier members, anchor members or other structural members; to create annular spaces for such things as concrete or pressure grouted piles; to mount rock drilling equipment; or to create precision placed holes in hard foundations.

One significant advantage of the use of an alignment system 20 and methods in accordance with embodiments of the present invention is that holes to be formed in the ground can be quickly and accurately positioned and aligned. When used with a compression hammer device 22 to form the holes, such as shown in FIG. 1, the holes created in the ground are made by compressing soil materials, which has the effect of increasing soil density around the hole, thereby creating a more rigid and accurate hole (i.e., within higher dimensional tolerances) when compared with holes created by drilling/boring/excavation.

Figure 8:
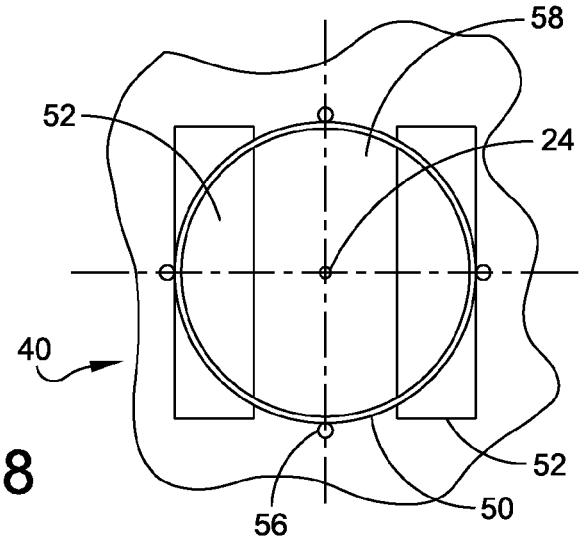
FIG. 8 illustrates an example of a removable alignment template secured into the ground, without the centering plate of FIG. 7, alignment template being centered about a survey nail, in accordance with an embodiment of the present invention.

The alignment system 20 and methods for providing precise alignment of a hole making device 22 can be used for instance to create a precisely positioned hole in the ground at a location previously marked by a survey hub 24 (i.e., a survey pin, survey nail, or survey mark or other marker for a desired location as shown in FIG. 8). However, it is understood that embodiments of the alignment system 20 can be used with or without the hole making device 22 of FIG. 1, or with different hole creating devices, depending upon the particular implementation. For instance, embodiments of the present invention could be modified to receive and align hole making devices that use drills or augers.

Moreover, without the use of the alignment system 20 described herein, during drilling or hammering to create a hole in the ground when a shaft hits a rock or rock layer in the ground, the shaft of the hole making device 22 could move off-line or would walk out of location. Embodiments of the present invention can be used to keep the shaft of a hole making device 22 (e.g., drill/hammer) precisely in-line during use.

Referring to FIG. 1, FIG. 1 shows an example of a hole making device 22 for forming a hole, wherein the device 22 can be mounted to an alignment system 20. The alignment system 20 then precisely guides the hole making device 22 in and out of the hole being formed. The hole making device 22, in the example of FIG. 1, may include a power hammer 30 such as a percussion-type hammer; a guide frame member 32, which is elongated and rigid and may be made of steel or other rigid material; a movement control assembly 34 for controllably moving the hammer 30 along the guide frame member 32. If desired, the hole making device 22 may include a centering plate 36 to position the hammer tip 38 relative to an alignment template 40, described below. The hole making device 22 may be adapted to be attached (via a boom 39 and a mount 41) to an excavator or other machinery (not shown) which can lift, move and place the hole making device 22 into a desired position or location.

Various examples of devices for forming holes are disclosed in co-pending, commonly owned U.S. patent application entitled "High Speed Precision Guide Device for Creating Holes for Piles or other Support Members," filed Jun. 25, 2012, U.S. patent application Ser. No. 13/532,602, the disclosure of which is hereby incorporated by reference in its entirety. In operation, when the hole making device 22 is placed into its working position to create a hole in the ground, the guide frame member 32 and hammer 30, 38 are vertically aligned and positioned, with the hammer 30 in an initial upward/top vertical position. As the hammer shaft 42 contacts the ground and begins to compress the ground materials, the hammer 30 is slowly and controllably moved downwardly along the guide frame member 32. A drive motor (not shown) drives the assembly 34 and the hammer 30 downwardly along the guide frame member 32, and therefore the hammer shaft 42 and tip 38 further penetrates, hammers and compacts into the ground as the hole is being created, until the point at which the full depth of the hole has been created. When the full depth of the hole has been created, the drive motor is stopped and reversed so that the hammer begins to move in an opposite upward direction out of the hole. Once the hammer shaft 42 and tip 38 have been removed from the hole, the drive motor can again be stopped, and the hole making device 22 can be repositioned to another location along the ground to begin the process to create another hole. If desired, a pile or other structural member may now be positioned in the hole (e.g., drilled into the hole), and examples of such piles are disclosed in co-pending, commonly-owned U.S. patent application entitled "Rotary Drive Tip System for Installation of Piles or other Foundation Members into the Ground" filed Jun. 25, 2012, U.S. patent application Ser. No. 13/532,623, the disclosure of which is hereby incorporated by reference in its entirety.

FIGS. 2-8 illustrate examples of an alignment system 20 that can be used to precisely align a hole making device 22. In one example, an alignment system includes an alignment template 40 (FIGS. 2-3) and a centering plate 44 (FIGS. 4-6), wherein the alignment template 40 is adapted to be placed along the ground, and the centering plate 44 is adapted to be placed within the alignment template 40 to align the alignment system 20. Once the desired alignment is achieved of the centering plate 44 within the alignment template 40, the alignment template 40 is secured into the ground and the centering plate 44 is removed from within the alignment template 40. The alignment template 40 is now ready to receive the centering plate 36 of the hole making device 22 (FIG. 1) in order to precisely align the hammer tip/shaft 38,42 of the hole making device 22.

Figure 2:
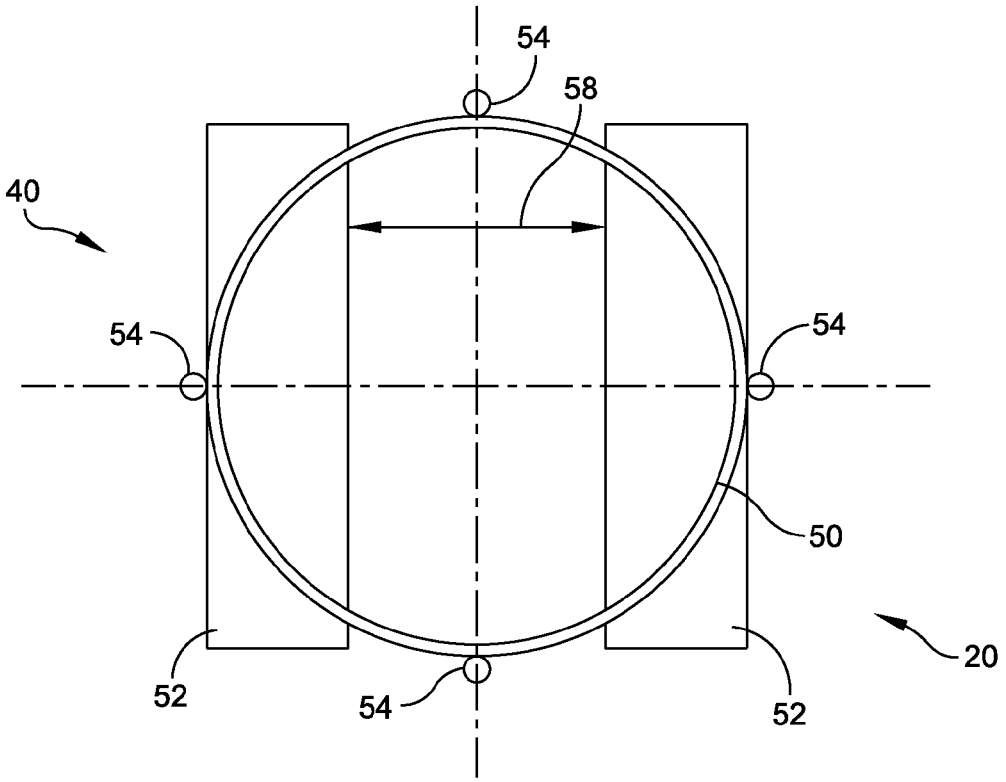
FIG. 2 illustrates an example an alignment template for receiving and aligning the distal end of the device of FIG. 1, in accordance with an embodiment of the present invention.
Figure 3:
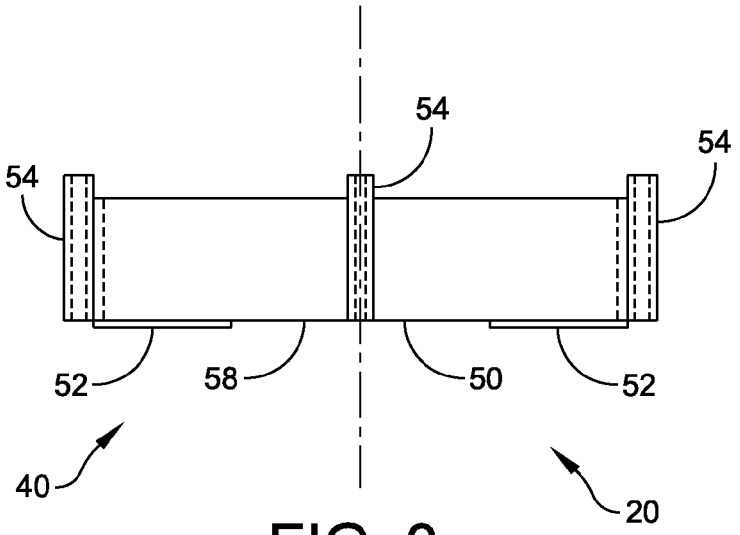
FIG. 3 illustrates a front view of the alignment template of FIG. 2, in accordance with an embodiment of the present invention.

As shown in FIGS. 2-3, an alignment template 40 may include a retaining ring 50 having one or more support plates 52 connected thereto along a lower edge. One or more pins sleeves 54 can be provided about the perimeter of the retaining ring 50, wherein each pin sleeve 54 is adapted to receive a securing stake or pin 56 penetrating the ground, thereby securing the alignment template 40 in place. As shown in FIG. 3, the pin sleeves 54 are positioned with the bottom ends substantially flush with the lower edge of the retaining ring 50, and the upper ends of the pin sleeves 54 extend above the upper edge of the retaining ring 50 to so pins 56 can be hammered by a user into the ground through the pin sleeves 54 without moving the alignment template 40.

In one example, the retaining ring 50 defines an annular sidewall which is angled at 90 degrees relative to the support plates 52 (which makes the sidewalls angled 90 degrees relative to the ground where the hole will be formed). This will therefore align the shaft 43 of the hole making device 22 at 90 degrees relative to the ground, in order to create a hole which is straight/perpendicular into the ground.

Alternatively, the template 40 can be provided with an angled or "battered" alignment in order to create a hole at a desired angle (i.e., non-perpendicular or non-orthogonal) relative to the surface of the ground (i.e., 45 degree angle, although other angles could be used). In one example, the retaining ring 50 defines an annular sidewall which is angled at 45 degrees relative to the support plates 52 (which makes the sidewalls angled 45 degrees relative to the ground where the hole will be formed). This will therefore align the shaft 43 of the hole making device 22 at 45 degrees relative to the ground, in order to create a hole which is angled at 45 degrees into the ground in this example.

In one example, the one or more support plates 52 are substantially flat and rectangular, and are positioned about opposing ends of the lower edge of the retaining ring 50. A gap or space 58 is defined between the interior edges of the support plates 52 within the interior of the area defined by the retaining ring 50.

The retaining ring 50, support plates 52, and pin sleeves 54 may be made of metal such as steel or other rigid material and welded or formed integrally together, so as to form alignment template 40. In one example, a heavy material such as steel helps to keep the alignment template 40 in place despite winds, rains, or other environmental conditions. Of course, once at least two securing pins 56 are hammered into the ground through at least two pin sleeves 54, the alignment template 40 will not typically move due to winds, rains or other conditions.

Figure 4:
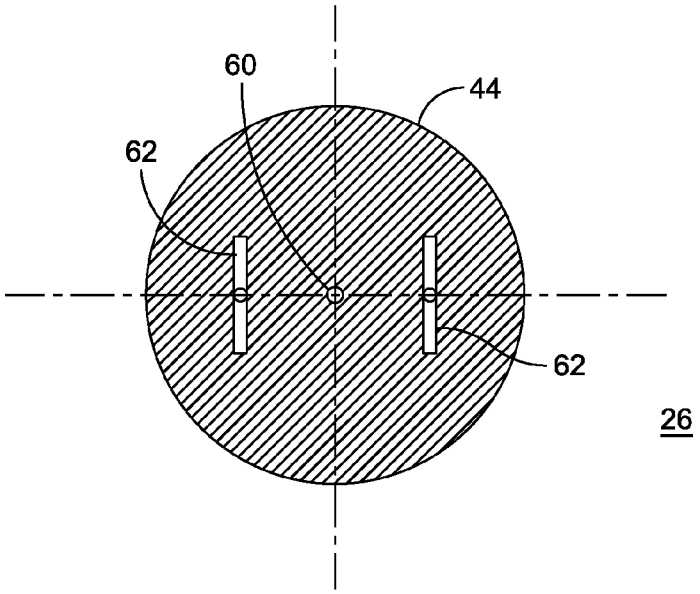
FIG. 4 illustrates an example a centering plate that is adapted to be inserted into the alignment template of FIG. 2, in accordance with an embodiment of the present invention.
Figure 5:
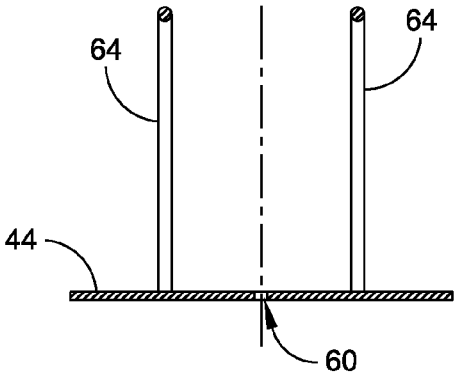
FIG. 5 illustrates a front view of the centering plate of FIG. 4, in accordance with an embodiment of the present invention.
Figure 6:
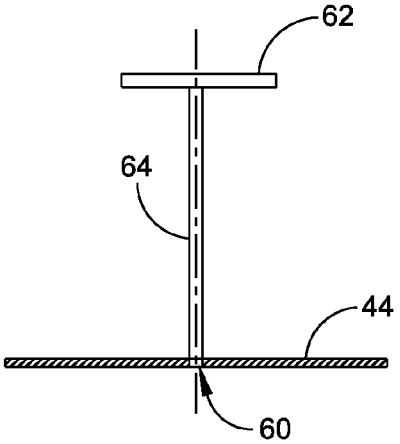
FIG. 6 illustrates a side view of the centering plate of FIG. 4, in accordance with an embodiment of the present invention.

Referring to FIGS. 4-6, one example of a centering plate 44 is illustrated. The centering plate 44 is generally circular and flat. At the center of the centering plate 44, a centering hole 60 is provided so that the centering plate 44 can be positioned atop a surveying hub or other marker 24 while the centering plate 44 is substantially flush to the ground. The centering plate 44 may be provided with one or more lifting handles 62 connected to the centering plate 44 via handle shafts 64. The centering plate 44 is sized so that it fits within the retaining ring 50 of the alignment template 40.

Figure 7A:
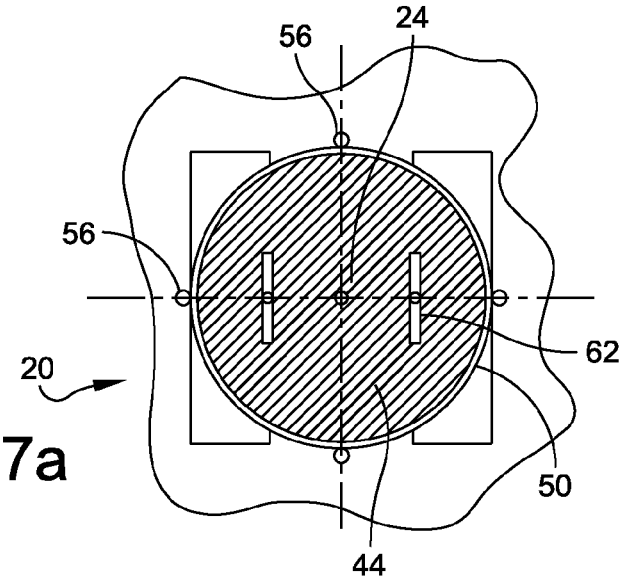
FIGS. 7*a-b* illustrate an example of an alignment template, with a centering plate positioned therein, the centering plate being centered about a survey hub, in accordance with an embodiment of the present invention.
Figure 7B:
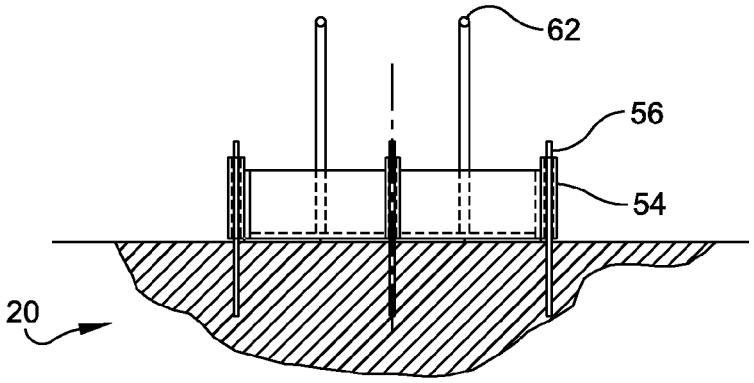

FIGS. 7*a*-*b* illustrate an example of a centering plate 44 positioned within an alignment template 40, wherein the centering plate 44 is centered on a survey hub 24. The securing pins 56 are positioned within the pin sleeves 54 so that the securing pins 56 can be hammered into the ground to secure the alignment template 40 in place. Then the centering plate 44 can be removed using its handles 62 by a user from the alignment template 40, as shown in FIG. 8, which leaves the alignment template 40 in the desired precise location ready to guide the hole making device 22 into place to create a hole precisely on the survey hub 24.

Figure 9:
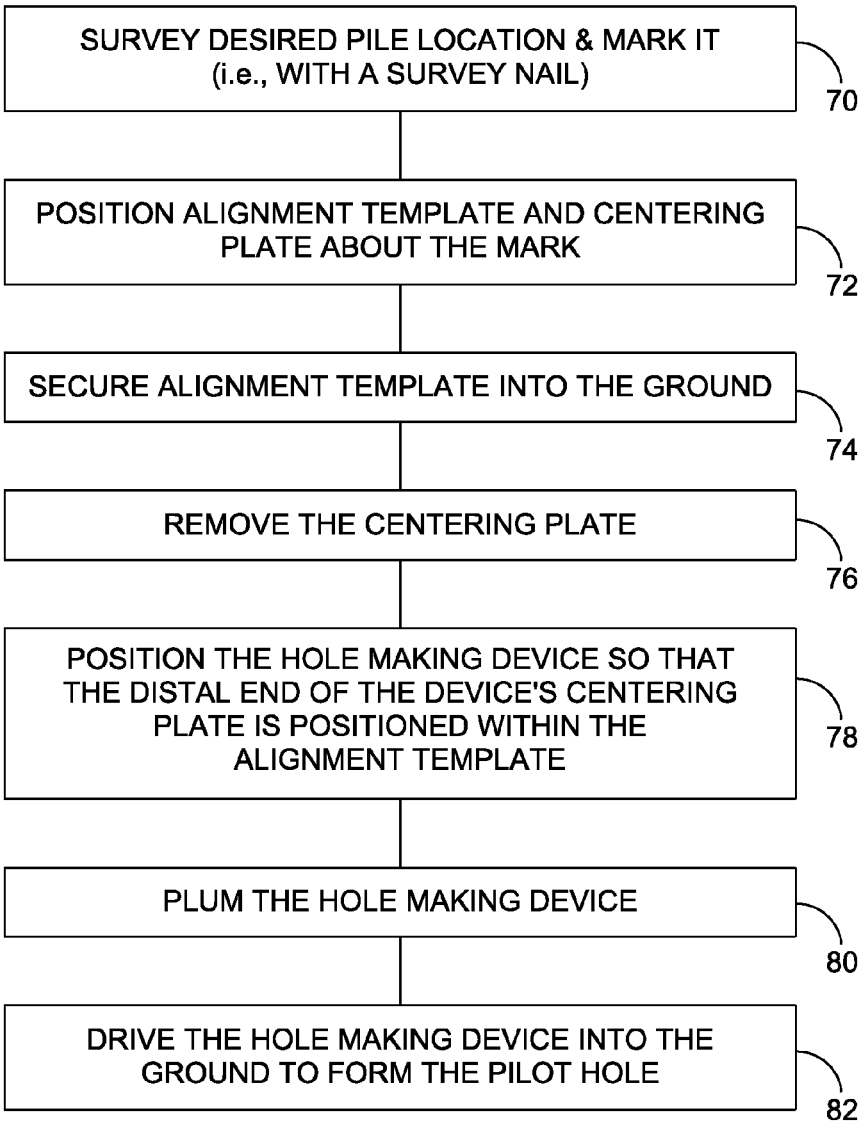
FIG. 9 illustrates an example of operations for forming a hole, such as a pilot hole, in accordance with an embodiment of the present invention.

FIG. 9 illustrates an example of a method for forming a hole, such as to receive a pile member or other structural member, in accordance with an embodiment of the present invention. At operation 70, a location is surveyed and marked with one or more locations where holes will be made in the ground. The survey marks may be made, for instance, with survey nails, survey stakes, survey hubs, or other conventional survey markers (these terms are used interchangably). At operation 72, an alignment template is positioned about/around the survey hub, and a centering plate is positioned within the alignment template so that the centering plate is centered on the survey hub.

At operation 74, the alignment template is secured into the ground, for instance by one or more securing pins being hammered into the ground through pin sleeves of the alignment template. At operation 76, the centering plate is removed from the alignment template, the alignment template having been aligned relative to the survey hub and secured to the ground.

At operation 78, a hole making device (such as a percussion-type hammer or other type of hole making device) is provided with one or more structures about its distal end that are adapted to mate with, key into, or fit within the alignment template. The hole making device is positioned so that the distal end of the hole making device is positioned within the alignment template. In this way and because the alignment template was aligned to the survey hub, and the hole making device is aligned with respect to the alignment template, the hole making device is now aligned with respect to the survey nail.

At operation 80, the hole making device is plumbed, for instance by a user, so that its shaft is on a true vertical line relative to the ground. In an alternative embodiment, if the template is designed with an angled or "battered" alignment in order to create a hole at a desired angle relative to the surface of the ground (i.e., 45 degree angle, although other angles could be used), then at operation 80 the hole making device would be plumed at the desired angle.

At operation 82, the hole making device is activated, so that the tip and shaft are driven into the ground, to form the desired hole at the position indicated by the survey hub. After the hole is formed, the hole making device is removed from the hole thereby exposing the hole for use. As mentioned above, due to the percussive nature of the power hammer when used in a hole making device, the hole is formed without materials such as spoils being brought to the surface, the hole having sidewalls with increased soil density, which tends to make the hole more rigid and improves its load bearing capacity when compared with holes formed by drilling. The hole is also plumb and straight.

Without limiting the scope of embodiments of the invention, an example of one implementation of the invention is described herein. In this example, a 30" diameter ¼" thick circular ring 4" tall was used for ring 50. On the outside of the ring, 4" tall, 1" diameter tubes were welded equidistant from each other as pin sleeves 54. On the outside of the ring two pieces of 6" wide by ¾" thick by 24" long steel bar plates were welded to the underside of the ring. One edge of the bar plate was placed at the outside diameter with the other side of the bar plate placed inside the ring. An ⅛" thick circular piece was cut to just fit inside the ring an act as a centering plate 44. A ¾" hole was drilled in the dead center of the centering plate. Two grab handles were affixed to the centering plate to allow for lifting and carrying. In use, a survey hub is placed in the field. The centering plate is placed inside the ring 50. The hole in the centering lid is placed about the survey hub, thereby automatically centering the centering plate. Once alignment is confirmed, retaining stakes are driven to hold the retaining ring in place. Once all stakes are driven and the survey hub is confirmed in the center of the centering plate, the centering plate is removed using the handles. In this manner, the alignment system is ready to receive the circular base of a precision guide device or hole making device, which precisely fits inside the centering ring, in order to drill or hammer on target a precision hole.

When tested by the inventor, the precision alignment system was used to place a series of pile members 6 feet into the ground, the piles being 5.5 inches diameter and 12 feet long—to within 0.5 inches of dead center of each pile relative to the survey hub, and plumb straight to within 1.0 degree.

While embodiments of the present invention have been described in terms of creating holes such as pilot holes for receiving pile members, embodiments of the present invention can be used for forming various types of holes in the ground, such as for drilled piers, for micros piles, for grouted piles, and for anchors of various types, for instance for various foundations, or for creating a hole for any other purpose.

While embodiments of the present invention have been shown and described in use with a power hammer within a hole making device for creating a hole in the ground, embodiments of the present invention could be used to align other devices that create holes in the ground such as auguring tools, boring tools, displacement tools, and drilling tools, depending upon the particular implementation.

While the methods disclosed herein have been described and shown with reference to particular operations performed in a particular order, it will be understood that these operations may be combined, sub-divided, or re-ordered to form equivalent methods without departing from the teachings of the present invention. Accordingly, unless specifically indicated herein, the order and grouping of the operations is not a limitation of the present invention.

It should be appreciated that reference throughout this specification to "one embodiment" or "an embodiment" or "one example" or "an example" means that a particular feature, structure or characteristic described in connection with the embodiment may be included, if desired, in at least one embodiment of the present invention. Therefore, it should be appreciated that two or more references to "an embodiment" or "one embodiment" or "an alternative embodiment" or "one example" or "an example" in various portions of this specification are not necessarily all referring to the same embodiment. Furthermore, the particular features, structures or characteristics may be combined as desired in one or more embodiments of the invention.

It should be appreciated that in the foregoing description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed inventions require more features than are expressly recited in each claim. Rather, as the following claims reflect, inventive aspects lie in less than all features of a single foregoing disclosed embodiment, and each embodiment described herein may contain more than one inventive feature.

While the invention has been particularly shown and described with reference to embodiments thereof, it will be understood by those skilled in the art that various other changes in the form and details may be made without departing from the spirit and scope of the invention.

The invention claimed is:

1. An alignment system for aligning a hole-making device for forming a hole in the ground, comprising:

an alignment template selectively securable to the ground; and a centering plate positionable within the alignment template, the centering plate having a hole adapted to be positioned on a survey hub, and the hole of the centering plate having a width sized smaller than an end of the hole-making device, wherein the width of the hole of the centering plate is configured to prevent the hole-making device from forming a hole in the ground when disposed within the alignment template, and wherein the alignment template, without the alignment template, is configured to align the hole-making device for forming the hole in the ground.

2. The alignment system of claim 1, wherein the alignment template includes at least one retaining ring.

3. The alignment system of claim 2, wherein the alignment template includes at least one pin sleeve attached on the outer perimeter of the ring, the pin sleeve receiving a pin to secure the alignment template to the ground.

4. The alignment system of claim 1, wherein the alignment template includes at least one support plate positioned along a lower edge of said retaining ring.

5. The alignment system of claim 1, wherein the alignment template includes at least two support plates positioned apart from each other along a lower edge of said retaining ring.

6. The alignment system of claim 1, wherein the alignment template includes at least one ring having an inner diameter that is greater than an outer diameter of the centering plate.

7. The alignment system of claim 1, wherein the centering plate has at least one handle.

8. The alignment system of claim 1, wherein the alignment template is adapted to receive a distal end of the hole making device.

9. An alignment system for aligning a hole-making device for forming a hole in the ground, comprising:

a centering plate having a hole adapted to be positioned on a survey hub, and the hole of the centering plate having a width sized smaller than an end of the hole-making device; and an alignment template selectively securable to the ground, the alignment template adapted to removably receive the centering plate in order to position the alignment template relative to the centering plate and the survey hub, and the alignment template adapted to removably receive an end of the hole making device in order to position the hole making device relative to the survey hub, wherein the width of the hole of the centering plate is configured to prevent the hole-making device from forming a hole in the ground when disposed within the alignment template, and wherein the alignment template, without the centering plate, is configured to align the hole-making device for forming the hole in the ground.

10. The alignment system of claim 9, wherein the centering plate has at least one handle.

11. The alignment system of claim 9, wherein the centering plate substantially defines a circle.

12. The alignment system of claim 9, wherein the hole of the centering plate is positioned in the center of the centering plate.

13. The alignment system of claim 9, wherein the alignment template includes at least one ring having an inner diameter that is greater than an outer diameter of the centering plate.

14. The alignment system of claim 13, wherein the alignment template includes at least one pin sleeve attached on the outer perimeter of the ring, the pin sleeve receiving a pin to secure the alignment template to the ground.

15. The alignment system of claim 9, wherein the alignment template includes at least one support plate positioned along a lower edge of said retaining ring.

16. A method for positioning a hole-making device to make a hole in the ground, the method comprising:

surveying a desired location for the hole;

marking the location of the hole;

positioning an alignment template about the marked location;

positioning a centering plate within the alignment template, the centering plate being positioned about the marked location;

securing the alignment template into the ground;

removing the centering plate from the alignment template; and positioning the hole making device within the alignment template.

17. The method of claim 16, further comprising vertically aligning the hole making device using a plum line.

18. The method of claim 16, wherein the marking operation includes driving a survey nail into the ground.

19. The method of claim 16, wherein the securing operation includes attaching one or more pin sleeves to the alignment template and driving one or more pins through the pin sleeves into the ground.

20. The method of claim 16, wherein the operation of positioning the hole making device within the alignment template further comprises inserting a tip of the hole making device within a receiving portion of the alignment template.

21. The system of claim 2, wherein the at least one retaining ring is substantially perpendicularly angled relative to the ground, so that the hole is made substantially plum to the ground.

22. The system of claim 2, wherein the at least one retaining ring is angled relative to the ground at a non-perpendicular angle, so that the hole is made at a non-perpendicular angle relative to the ground.

* * * * *